US007497961B2

(12) United States Patent
Keenan et al.

(10) Patent No.: US 7,497,961 B2
(45) Date of Patent: Mar. 3, 2009

(54) METHOD OF MAKING AN INKJET PRINTHEAD

(75) Inventors: Phil Keenan, Lucan (IE); Maurice Byrne, Dublin (IE); Odhran Hendley, Kildare (IE); Michelle Ryan Meleady, Kildare (IE); Fred Logue, Meath Co. (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 314 days.

(21) Appl. No.: 11/041,989

(22) Filed: Jan. 26, 2005

(65) Prior Publication Data

US 2005/0179742 A1 Aug. 18, 2005

(30) Foreign Application Priority Data

Jan. 29, 2004 (GB) ..... 0401870.1

(51) Int. Cl.
*B41J 2/165* (2006.01)
*B41J 29/38* (2006.01)
*G03C 5/00* (2006.01)

(52) U.S. Cl. ..... 216/27

(58) Field of Classification Search ..... None
See application file for complete search history.

(56) References Cited

U.S. PATENT DOCUMENTS

| | | | | |
|---|---|---|---|---|
| 5,006,202 | A * | 4/1991 | Hawkins et al. | 216/27 |
| 5,131,978 | A | 7/1992 | O'Neill | |
| 5,781,994 | A | 7/1998 | Fouillet et al. | |
| 6,766,817 | B2 | 7/2004 | Da Silva | |
| 7,063,799 | B2 * | 6/2006 | Hayakawa et al. | 216/83 |
| 2002/0167553 | A1 * | 11/2002 | Nikkel | 347/1 |
| 2003/0034325 | A1 | 2/2003 | Hart et al. | |
| 2003/0142185 | A1 * | 7/2003 | Donaldson et al. | 347/93 |
| 2003/0186474 | A1 * | 10/2003 | Haluzak et al. | 438/21 |
| 2005/0174388 | A1 * | 8/2005 | Miyamoto et al. | 347/56 |

FOREIGN PATENT DOCUMENTS

| | | |
|---|---|---|
| JP | 9-136421 | 5/1997 |
| JP | 11-277755 | 10/1999 |

* cited by examiner

*Primary Examiner*—Allan Olsen

(57) ABSTRACT

A method of making an inkjet printhead comprises forming at least one ink ejection element 18 on a surface 14 of a substrate 10 and forming a slot 12 in the substrate to provide fluid communication between an ink supply and the ink ejection element. A protective coating 26 is applied to the surface of the substrate prior to forming the slot. The protective coating comprises a non-polymeric material which is capable of forming a covalent bond with the substrate and is removed from the substrate without damaging the ink ejection element following slot formation.

17 Claims, 5 Drawing Sheets

METHOD OF MAKING AN INKJET PRINTHEAD

TECHNICAL FIELD

This invention relates to a method of making an inkjet printhead.

BACKGROUND ART

Inkjet printers operate by ejecting small droplets of ink from individual orifices in an array of such orifices provided on a nozzle plate of a printhead. The printhead may form part of a print cartridge which can be moved relative to a sheet of paper and the timed ejection of droplets from particular orifices as the printhead and paper are relatively moved enables characters, images and other graphical material to be printed on the paper.

A typical conventional printhead is fabricated from a silicon substrate having thin film resistors and associated circuitry deposited on its front surface. The resistors are arranged in an array relative to one or more ink supply slots in the substrate, and a barrier material is formed on the substrate around the resistors to isolate each resistor inside a thermal ejection chamber. The barrier material is shaped both to form the thermal ejection chambers, and to provide fluid communication between the chambers and the ink supply slot. In this way, the thermal ejection chambers are filled by capillary action with ink from the ink supply slot, which itself is supplied with ink from an ink reservoir in the print cartridge of which the printhead forms part.

The composite assembly described above is typically capped by a metallic nozzle plate having an array of drilled orifices which correspond to and overlie the ejection chambers. The printhead is thus sealed by the nozzle plate, but permits ink flow from the print cartridge via the orifices in the nozzle plate.

The printhead operates under the control of printer control circuitry which is configured to energise individual resistors according to the desired pattern to be printed. When a resistor is energised it quickly heats up and superheats a small amount of the adjacent ink in the thermal ejection chamber. The superheated volume of ink expands due to explosive evaporation and this causes a droplet of ink above the expanding superheated ink to be ejected from the chamber via the associated orifice in the nozzle plate.

Many variations on this basic construction will be well known to the skilled person. For example, a number of arrays of orifices and chambers may be provided on a given printhead, each array being in communication with a different coloured ink reservoir. The configurations of the ink supply slots, printed circuitry, barrier material and nozzle plate are open to many variations, as are the materials from which they are made and the manner of their manufacture.

The typical printhead described above is normally manufactured simultaneously with many similar such printheads on a large area silicon wafer which is only divided up into individual printhead dies at a late stage in the manufacture. FIG. 1 is a plan view of the front surface of a substantially circular silicon wafer 10 typically used in the manufacture of printheads. The wafer 10 has a large number of slots 12 each extending fully through the thickness of the wafer. In FIG. 1 the slots 12 are grouped in threes, as would be the case where the wafer is to be used in the manufacture of printheads for colour printing. The rear surface (not seen in FIG. 1) of the wafer 10 has grooves running vertically between each group of three slots 12 and horizontally between each row of slots 12 so that ultimately the wafer can be divided up, for example, using a conventional dicing saw into individual "dies" each containing one group of three slots 12.

In the final printhead each slot 12 supplies ink to one or more ink ejection chambers disposed along one or both sides of the slot on the front surface of the wafer. Although, for reasons of mass production, the ink supply slots 12 are almost always formed in the undivided wafer 10, they can be formed at any of a number of different stages of production. However, although the slots 10 can be formed in the initial "raw" wafer, as seen in FIG. 1, it is preferred to form the slots when the front surface of the wafer already bears the thin film resistors and other circuitry. This is because an unslotted wafer presents an uninterrupted front surface for the application and patterning of the various layers forming the thin film circuitry. If the slots were present they would need to be temporarily blocked off, for example, in the manner disclosed in European Patent Application No. EP 1,297,959, or other measures would need to be taken to avoid leaving undesired materials in the slots.

However, if the slots are formed when the front surface of the wafer already bears the thin film circuitry, the latter needs to be covered with a protective coating to avoid damage to the delicate and critical thin film structures. A coating of polyvinyl alcohol (PVA) is conventionally used to protect these structures. For example, a typical protective coating is built up by applying five successive layers of PVA each approximately 2.5 microns thick.

The slots 12 are conventionally formed by laser machining or sand blasting, usually from the rear surface of the wafer. Laser machining is preferred since sand blasting leads to dimensional instability and chipping. However, we have found that conventional PVA coatings provide acceptable protection for the critical thin film structures only when slotting with relatively low power lasers, e.g. 7.5 W lasers, and then only when slotting from the rear surface of the laser. The reason is that the high plasma temperature associated with higher power lasers, such as 15 W and 20 W lasers, tends to lift the PVA coating at the edges of the slot when breaking through the front surface (whether from the front or rear), so that the laser machining plasma gets under the edges of the PVA to damage the thin film circuitry and deposit wafer debris thereon. Quite apart from the desirability of reducing the damage caused by higher power lasers, it would be desirable to be able to effect slotting from the front surface of the wafer since then the wafer can be slotted simultaneously from both the front and rear surfaces to improve throughput.

It is an object of the invention to provide an improved method of making an inkjet printhead in which these disadvantages are avoided or mitigated.

DISCLOSURE OF THE INVENTION

The invention provides a method of making an inkjet printhead comprising: applying a protective coating to a surface of a substrate, the protective coating comprising a non-polymeric material, forming an ink supply slot in the substrate, the slot extending through the protected surface, and removing the protective coating from the substrate following formation of the ink supply slot without damaging the protected surface.

The protective coating material preferably comprises a compound of the formula $M_2Si_xO_y$, wherein M is an alkali metal, x=1, 2 or 4 and y=2, 3, 4, 5 or 9 provided that when x=1, y=2, 3 or 4; when x=2, y=5; and when x=4, y=9.

Preferably the alkali metal is one of sodium, potassium or lithium, especially sodium.

Alternatively, the protective coating material comprises a compound which includes germanium.

The protective coating is preferably applied as a liquid which will form a hard protective coating on drying prior to slot formation. Drying is conveniently carried out by "soft baking", i.e. at a temperature in the range of 35° C. to 80° C. for a period of from about 30 sec to ten min. Where the coating is a sol gel, it may actually harden with time at ambient temperatures but this may take some days.

In one embodiment, the hard protective coating is sodium metasilicate which is transparent.

After formation of the slot, the hard protective coating may be removed by, for example, rinsing the substrate in an inert solvent in which the coating is soluble and applying heat if necessary.

As used herein, the terms "inkjet", "ink supply slot" and related terms are not to be construed as limiting the invention to devices in which the liquid to be ejected is an ink. The terminology is shorthand for this general technology for printing liquids on surfaces by thermal, piezo or other ejection from a printhead. While the primary intended application is the printing of ink, the invention will also be applicable to printheads which deposit other liquids in like manner, for example, as described in our copending patent application entitled "A Method of Making an Inkjet Printhead" (HP Ref: PD No. 200315481 Attorney Ref: pg10145ie00).

Furthermore, the method steps as set out herein and in the claims need not necessarily be carried out in the order stated, unless implied by necessity.

BRIEF DESCRIPTION OF THE DRAWINGS

In the drawings, which are not to scale, the same parts have been given the same reference numerals in the various figures.

DESCRIPTION OF PREFERRED EMBODIMENT

Figure 1:
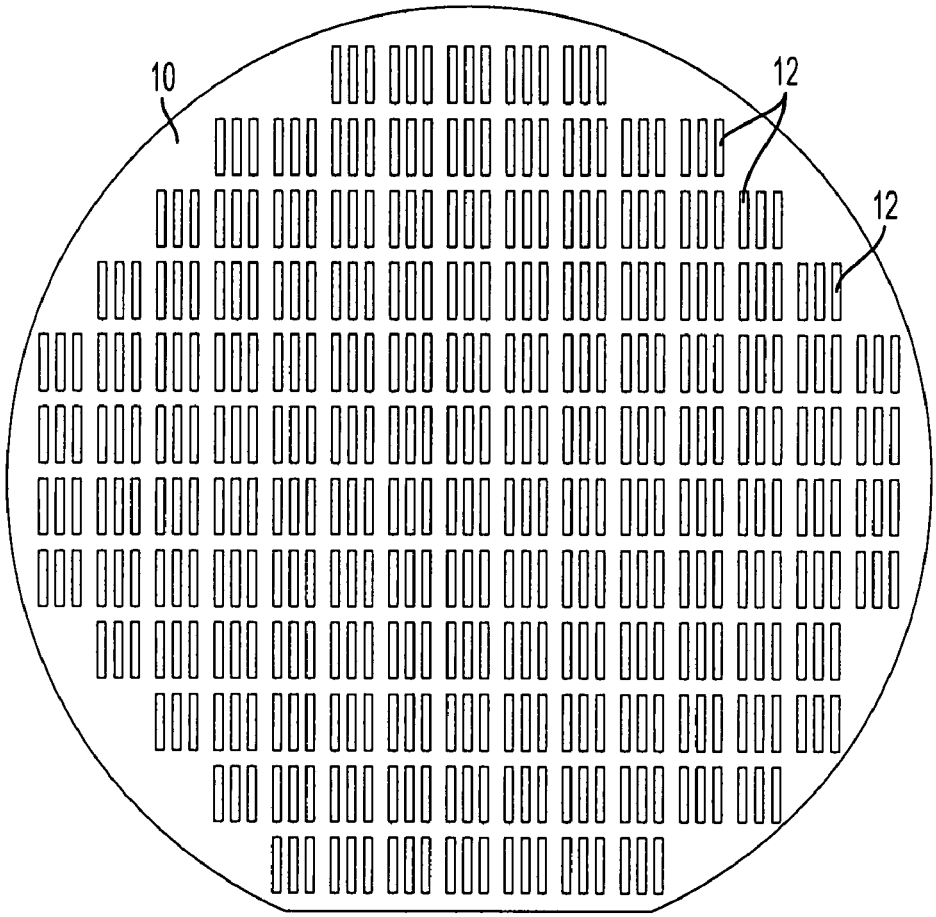
FIG. 1, previously described, is a plan view of a silicon wafer used in the manufacture of printheads according to an embodiment of the invention.
Figure 2:
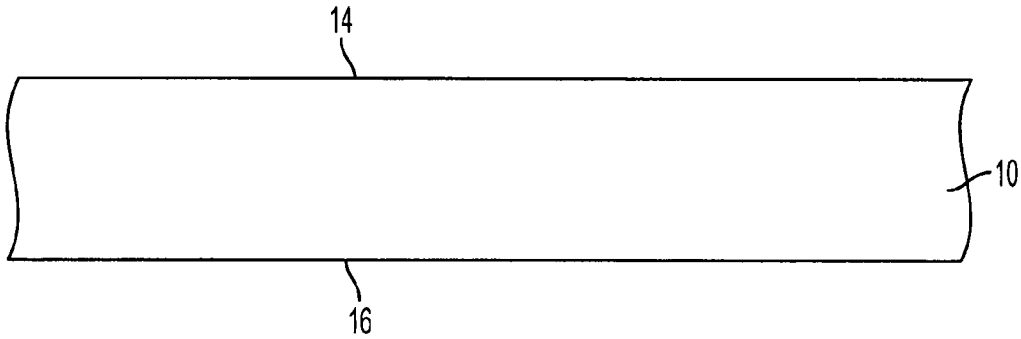
FIGS. 2 to 6 show successive steps in making a printhead according to the embodiment of the invention.

FIG. 2 shows, in fragmentary cross-sectional side view, a substantially circular silicon wafer 10 of the kind previously referred to and typically used in the manufacture of conventional inkjet printheads. The wafer 10 has a thickness of 675 μm and a diameter of 150 mm. The wafer 10 has opposite, substantially parallel front and rear major surfaces 14 and 16 respectively, the front surface 14 being flat, highly polished and free of contaminants in order to allow ink ejection elements to be built up thereon by the selective application of various layers of materials in known manner.

The first step in the manufacture of a printhead according to the embodiment of the invention is to process the front surface 114 of the wafer in conventional manner to lay down an array of thin film heating resistors 18 (FIG. 7) which, in the embodiment, are connected via conductive traces to a series of contacts which are used to connect the traces via flex beams with corresponding traces on a flexible printhead-carrying circuit member (not shown) mounted on a print cartridge. The flexible printhead-carrying circuit member enables printer control circuitry located within the printer to selectively energise individual resistors under the control of software in known manner. As discussed, when a resistor 18 is energised it quickly heats up and superheats a small amount of the adjacent ink which expands due to explosive evaporation. The resistors 18, and their corresponding traces and contacts, are not shown in FIGS. 3 to 6 due to the small scale of these figures, but methods for their fabrication are well-known.

Figure 3:
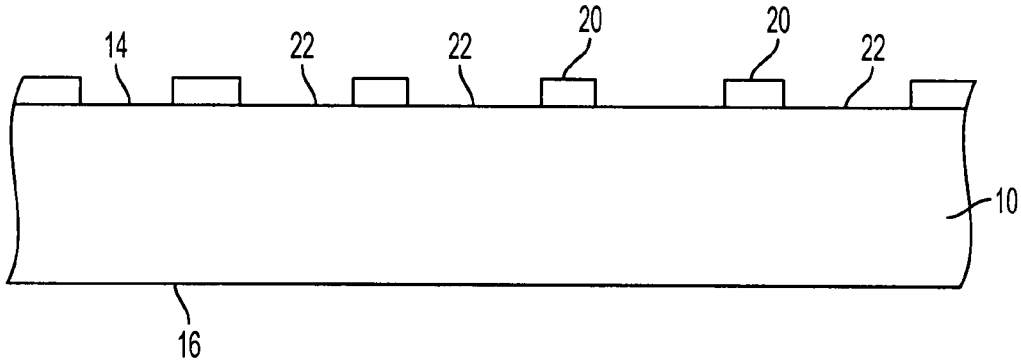

After laying down the resistors 18, a blanket barrier layer 20 of, for example, dry photoresist is applied to the entire front surface 14 of the wafer 10 and selected regions 22 of the photoresist are removed and the remaining portions of photoresist are hard baked. The result is shown in FIG. 3. Each region 22 is centered over a region of the substrate 10 where a respective slot 12 will be formed, and extends along substantially the full length of the slot. In the finished printhead, the regions 22 define the lateral boundaries of a plurality of ink ejection chambers 24, FIG. 7. Again, the formation of the barrier layer is part of the state of the art and is familiar to the skilled person.

Figure 4:
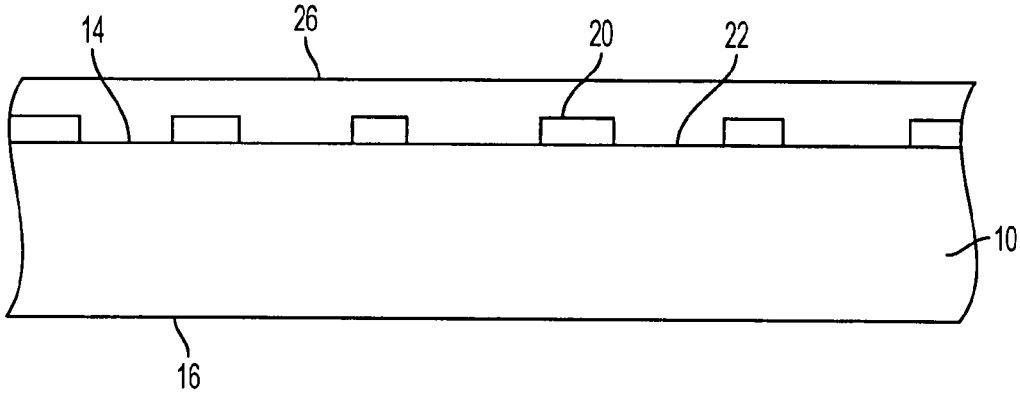

Next, FIG. 4, a blanket protective coating 26 of a sol gel is deposited over the entire front surface 14 of the wafer, covering the resistors 18, barrier layer 20 and other thin film circuitry. The sol gel is applied as a liquid and dries to form a refractory protective coating with excellent laser protection properties.

The sol gel coating 26 used in the present embodiment may be formed by reacting sodium oxide ($Na_2O$) with silicon dioxide ($SiO_2$) and water where the ratio of $Na_2O$:$SiO_2$ is between 1.6 and 3.22 by weight.

It has the consistency of maple syrup (2100 cp at 25° C.) and is spin-coated onto the front surface of the wafer. The sol gel is then soft baked at a temperature of about 35° C.-80° C. for about 30 sec-10 mins to drive off excess water resulting in a hard transparent sodium metasilicate coating 26 on the wafer surface that is highly resistant to heat and strongly adheres, by forming a covalent bond, with the wafer surface. Importantly, the sol gel coating 26 is water soluble provided it is not hard baked (>400° C.) and is therefore removable with hot water after laser slotting.

The sol gel used in the present embodiment can be obtained as an off-the-shelf item from PQ Corporation, Belgium. It is normally used in detergents, pulp and paper, water treatment, construction, textiles, as cements for ceramics, drilling muds, and metal ore treatment.

The particular processing steps used in the present embodiment are:

(1) The wafer 10 is mounted onto the chuck of a spin coater.

(2) The wafer is rinsed with de-ionised (DI) water and then spun at approx. 1000 rpm for approx. 10 s to remove excess water. This step ensures that the sol gel completely fills the features on the wafer to form a flat coating.

(3) 10 cc of sol gel is dispensed onto the wafer. According to circumstances, the whole wafer may be covered before spinning, or spiral coverage may be used. To control drying time the spinning is performed in a closed bowl with the temperature at 25° C. and humidity at approximately 90% RH to enable reproducible coating results.

(4) The wafer is spun for 15 s at 2000 rpm to uniformly spread the coating across it. It is then spun for 30 s at 500 rpm to achieve the desired thickness and minimise thickness variations.

(5) The wafer is then baked on a hot plate or in an oven at 50° C. for 60 s. Water is driven off and the coating densities and hardens.

To enable conforming coatings for three dimensional surfaces such as a thermal inkjet with its barrier layer in place, better channel filling can be achieved by applying two layers: first a low viscosity thin layer is applied which partially fills the barrier channels to around five microns deep, then a high viscosity material is applied that completely fills the channels. An additional protective layer may then be applied.

Preferably the thickness of the coating 26 is below a critical value of 15 microns to avoid degradation of the coating caused by absorption of moisture from the atmosphere. For similar reasons, the coating 26 is preferably processed and removed within approximately 1 week of application.

Figure 5:
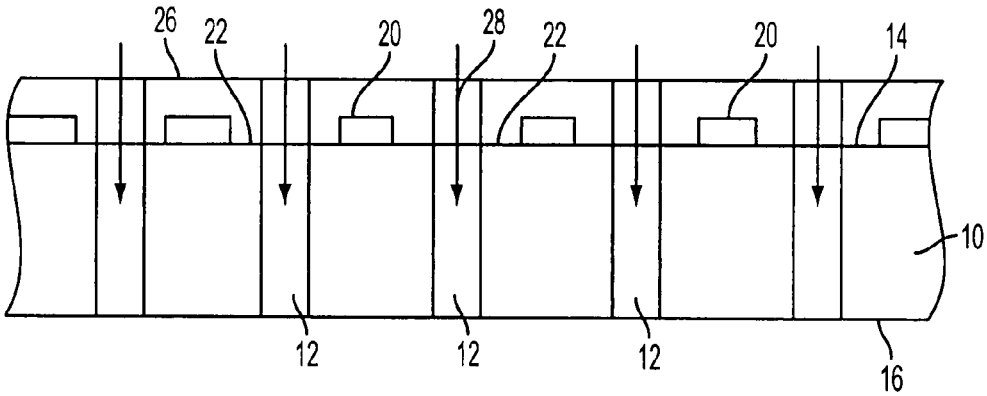

Now, FIG. 5, the ink supply slots 12 are laser machined fully through the thickness of the hardened layer 26 and wafer 10 using one or more narrow laser beams 28 (not all the slots 12 are necessarily machined simultaneously as suggested by the presence of beams 28 in all the slots 12 in FIG. 5). Due to the higher protection afforded by the hardened layer 26, the laser power can be higher than that used conventionally; for example, 15 W or 20 W lasers can be used. The slots 12 could alternatively be cut by reactive ion etching, wet etching or sand blasting. In the preferred embodiment, the slots 12 are cut downwardly into the front surface 14 as indicated by the arrows 28 representing the laser beams. In this embodiment each slot 12 is centered between a respective pair of adjacent barrier portions 20.

If desired the wafer 10, including its protective layer 26, can now be subjected to an isotropic etch as described in our copending patent application entitled "A Method of making an Inkjet Printhead" (HP Ref: PD No. 200209463-1 Attorney Ref: pg10143ie00).

After laser machining the wafer is washed using the following process to remove the hardened coating 26:

(1) Rinse wafer in 80° C. DI (de-ionised) water for 90 s.

(2) Rinse wafer with cold DI water and brushes for 60 s.

(3) Apply hot steam water for 99 s at 80° C.

(4) Apply ultrasonically agitated hot DI water at 80° C.

(5) Spin dry wafer at 1800 rpm for 70 s.

Figure 6:
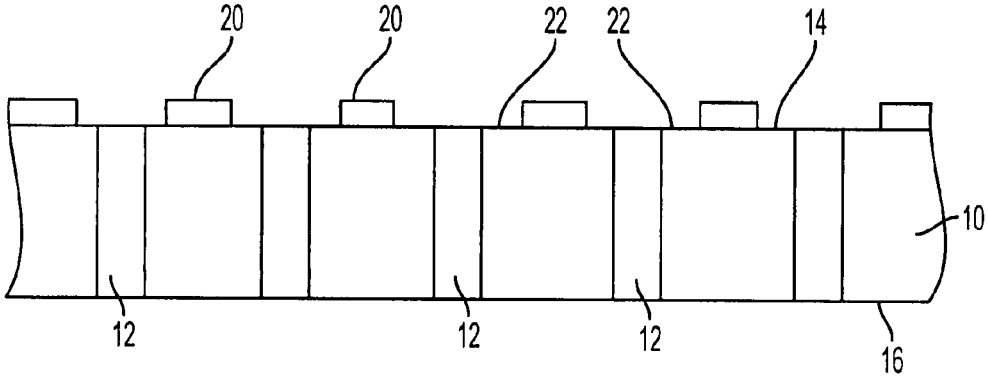

This is only an example of a cleaning recipe and the wafer may be adequately cleaned using other parameters and techniques and/or omitting some of the above steps. The result is shown in FIG. 6.

Figure 7:
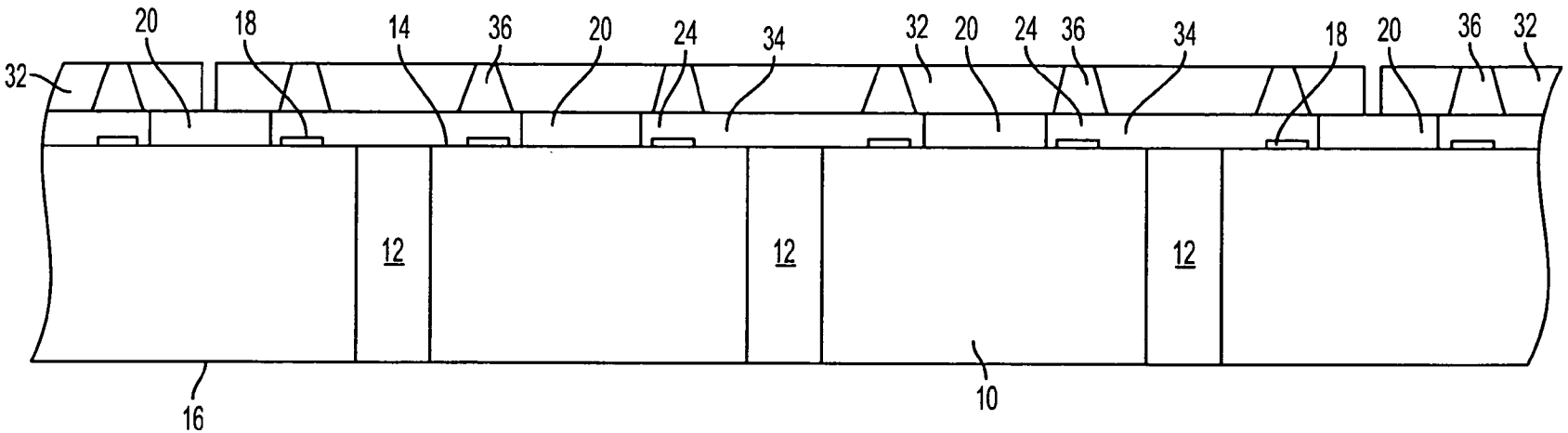
FIG. 7 is a cross-section of the final printhead made by the method of FIGS. 2 to 6.

Next, pre-formed metallic nozzle plates 32 (FIG. 7) are applied to the top surface of the barrier layer 20 in a conventional manner, for example by bonding. The nozzle plates are applied on a die-by-die basis, i.e. individual nozzle plates 32 are applied to respective underlying portions of the wafer which will correspond in the subsequently divided wafer to individual printhead dies. The final composite structure, whose cross-section is seen in FIG. 7, comprises a plurality of ink ejection chambers 24 disposed along each side of each slot 12 although, since FIG. 7 is a transverse cross-section, only one chamber 24 is seen on each side of each slot 12. Each chamber 24 contains a respective resistor 18, and an ink supply path 34 extends from the slot 12 to each resistor 18. Finally, a respective ink ejection orifice 36 leads from each ink ejection chamber 24 to the exposed outer surface of the nozzle plate 32. It will be understood that the manufacture of the structure above the wafer surface 14, i.e. the structure containing the ink ejection chambers 24, the ink supply paths 34 and the ink ejection orifices 36 as described above, can be entirely conventional and well known to those skilled in the art.

Figure 8:
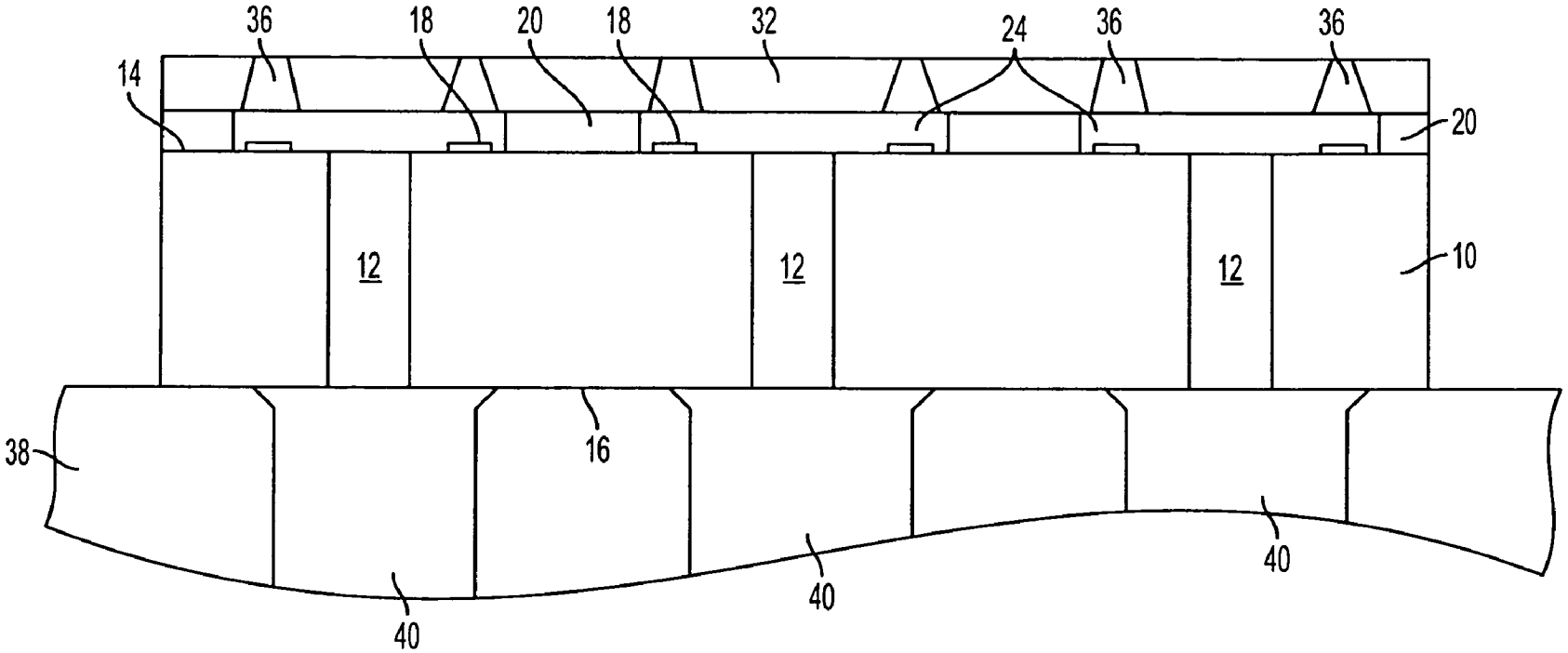
FIG. 8 is a cross-sectional view of a print cartridge incorporating the printhead of FIG. 7.

Finally, the wafer processed as above is diced to separate the individual printheads from the wafer and each printhead is mounted on a print cartridge body 38, FIG. 8, having respective apertures 40 for supplying ink from differently coloured ink reservoirs (not shown) to the printhead. To this end the printhead is mounted on the cartridge body 38 with each aperture 40 in fluid communication with a respective slot 12 in the wafer 10.

Although the slots 12 in each group of three slots are shown as disposed side by side, they could alternatively be disposed end to end or staggered or otherwise offset without departing from the scope of this invention. Also, in the case of a printhead which uses a single colour ink, usually black, only one ink supply slot 12 will be required per printhead.

Although the foregoing has described an embodiment where the slots 12 are laser machined part way through the processing of the wafer 10, they could be formed right at the beginning, i.e. on the raw wafer, or at any other suitable point in the wafer processing provided the thin film resistors and other circuitry added later, to the extent they are present, or the silicon wafer surface are suitably protected by the hardened layer.

It will also be seen that the slots 12 could be machined by laser drilling into the wafer from the rear surface 16. In that case it would be preferred to apply a protective coating of hardened to the rear surface as well as the front surface, by the process described above. Simultaneous laser machining of the slots could also be performed from both the front and rear surfaces of the wafer, again with both surfaces protected by a hardened layer as described.

It will be seen that the preferred embodiment has been described in terms of a sodium metasilicate protective coating. However, the protective coating material may more generally comprise a compound of the formula $M_2Si_xO_y$, wherein M is an alkali metal, x=1, 2 or 4 and y=2, 3, 4, 5 or 9 provided that when x=1, y=2, 3 or 4; when x=2, y=5; and when x=4, y=9. Preferably the alkali metal is one of sodium, potassium or lithium.

As an alternative to using a sol gel as the protective coating 26, a spin-on glass including glass frit (silica based), phosphosilicate or siloxane is also suitable. Provided these are not fired (hard baked) they can be removed after laser etching with water/steam. Because these materials are silicon based they have a high affinity for the silicon/silicon dioxide wafer and bond with the wafer even during a soft bake. In all cases, however, the selected coating must be capable of being removed from the wafer without damage to the resistors 18 and associated thin film circuitry.

The invention is not limited to the embodiment described herein and may be modified or varied without departing from the scope of the invention.

What is claimed is:

1. A method of making an inkjet printhead comprising:

applying a protective coating to a surface of a substrate, the protective coating comprising a non-polymeric material, wherein the protective coating material comprises a compound of the formula $M_2Si_xO_y$, wherein M is an alkali metal, x=1, 2 or 4 and y=2, 3, 4, 5 or 9 provided that when x=1, y=2, 3 or 4; when x=2, y=5; and when x=4, y=9;

forming an ink supply slot in the substrate, the slot extending through the protected surface; and removing all of the protective coating from the substrate following formation of the ink supply slot without damaging the protected surface.

2. A method as claimed in claim 1 wherein the non-polymeric material forms a covalent bond with the substrate.

3. A method as claimed in claim 1, wherein the protective coating is removed by a solvent.

4. A method as claimed in claim 1, wherein the alkali metal is one selected from the group consisting of sodium, potassium, and lithium.

5. A method as claimed in claim 1, wherein the printhead is one of a plurality of such printheads formed substantially simultaneously on the substrate, the method further comprising dividing the substrate into individual printheads after ink supply slot formation.

6. A method as claimed in claim 1, wherein the substrate is a semiconductor substrate.

7. A method as claimed in claim 6, wherein the substrate is a silicon substrate.

8. A method as claimed claim 1, wherein the ink supply slot is formed at least partially by material removal from the surface bearing the protective coating.

9. A method as claimed in claim 8, wherein the ink supply slot is formed by laser machining.

10. A method as claimed in claim 1, wherein the protective coating is applied as a liquid which forms a hard protective coating on drying prior to formation of the ink supply slot.

11. A method as claimed in claim 10, wherein the protective coating is applied as a colloidal suspension and wherein the substrate is heated to dry said coating.

12. A method as claimed in claim 10, wherein the hard protective coating is transparent.

13. A method as claimed in claim 1 further comprising the step of forming at least one ink ejection element on a surface of the substrate.

14. A method as claimed in claim 13 wherein the ink supply slot provides fluid communication between an ink supply and the ink ejection element.

15. A method as claimed in claim 13, wherein the ink supply slot is formed after the ink ejection element is at least partially formed on the surface of the substrate.

16. A method as claimed in claim 15, wherein the ink ejection element comprises thin film circuitry deposited on the surface of the substrate, a barrier layer applied over the thin film circuitry, and a nozzle plate applied over the barrier layer, the barrier layer and nozzle plate together defining the at least one ink ejection chamber, and wherein the ink supply slot is formed after the application of the barrier layer and before the application of the nozzle plate.

17. A method of making an inkjet printhead comprising:

applying a protective coating to a surface of a substrate, the protective coating comprising a non-polymeric material and being entirely removed from the substrate following formation of an ink supply slot without damaging the protected surface, wherein the protective coating material comprises a compound of the formula $M_2Si_xO_y$, wherein M is an alkali metal, x=1, 2 or 4 and y=2, 3, 4, 5 or 9 provided that when x=1, y=2, 3 or 4; when x=2, y=5; and when x=4, y=9; and forming an ink supply slot in the substrate, the slot extending through the protected surface.

* * * * *